US009962975B2

(12) United States Patent
Obara

(10) Patent No.: US 9,962,975 B2
(45) Date of Patent: May 8, 2018

(54) PRINTER, AND DETECTION METHOD FOR A DETECTION AREA ON A SHEET

(71) Applicant: Seiko Instruments Inc., Chiba-shi, Chiba (JP)

(72) Inventor: Takumi Obara, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 0 days. days.

(21) Appl. No.: 15/412,693

(22) Filed: Jan. 23, 2017

(65) Prior Publication Data

US 2017/0210157 A1 Jul. 27, 2017

(30) Foreign Application Priority Data

Jan. 26, 2016 (JP) ..... 2016-012532

(51) Int. Cl.
*B41J 2/32* (2006.01)
*B41J 29/38* (2006.01)

(52) U.S. Cl.
CPC *B41J 29/38* (2013.01); *B41J 2/32* (2013.01)

(58) Field of Classification Search
CPC ..... B41J 13/00; B41J 13/0009; B41J 15/00; B41J 15/04; B41J 15/044; B41J 15/046
See application file for complete search history.

(56) References Cited

FOREIGN PATENT DOCUMENTS

JP 2011-110778 A 6/2011

*Primary Examiner* — Kristal Feggins
(74) *Attorney, Agent, or Firm* — Brinks Gilson & Lione

(57) ABSTRACT

A printer includes a conveying unit configured to convey a sheet having a detection area on at least a portion of a sheet surface; a sensor configured to output a detection signal in accordance with a surface of the sheet conveyed by the conveying unit; an acquisition unit configured to acquire, at a predetermined interval in accordance with conveyance of the sheet, the detection signal output from the sensor; a detection unit configured to detect the detection area based on an integrated value of a change amount of the detection signal acquired at the predetermined interval by the acquisition unit; and a printing control unit configured to control a printing position for printing on the sheet based on the detection area detected by the detection unit.

12 Claims, 12 Drawing Sheets

PRINTER, AND DETECTION METHOD FOR A DETECTION AREA ON A SHEET

RELATED APPLICATIONS

This application claims priority under 35 U.S.C. § 119 to Japanese Patent Application No. 2016-012532 filed on Jan. 26, 2016, the entire content of which is hereby incorporated by reference.

BACKGROUND OF THE INVENTION

1. Field of the Invention

The present invention relates to a printer, and a method for detecting a detection area on a sheet.

2. Description of the Related Art

Hitherto, for a printer, as means for detecting a reference position on a sheet drawn from a roll sheet, there has been known a method in which a mark is displayed on a sheet surface, or a gap portion is formed between sheets (between labels), and a printing position or a printing start position is detected by detecting the mark or the gap portion. For example, when the mark or the gap portion is detected, the detection is performed by using a reflective sensor or a transmissive sensor (photoelectric sensor), and performing a threshold judgment on an analog-digital (AD) value obtained by AD-conversion of an output voltage from the sensor.

Therefore, in that technical field, there has been a need for a printer with a detection device, and a detection method, which are capable of easily detecting a detection area provided on a sheet surface.

SUMMARY OF THE INVENTION

According to one embodiment of the present invention, there is provided a printer, including: a conveying unit configured to convey a sheet having a detection area on at least a portion of a sheet surface; a sensor configured to output a detection signal in accordance with a surface of the sheet conveyed by the conveying unit; an acquisition unit configured to acquire, at a predetermined interval in accordance with conveyance of the sheet, the detection signal output from the sensor; a detection unit configured to detect the detection area based on an integrated value of a change amount of the detection signal acquired at the predetermined interval by the acquisition unit; and a printing control unit configured to control a printing position for printing on the sheet based on the detection area detected by the detection unit.

In the above-mentioned printer according to the one embodiment of the present invention, wherein he detection unit is configured to: calculate the integrated value each time the acquisition unit acquires the detection signal at the predetermined interval; and judge, when a period in which the integrated value is continuously equal to or more than a predetermined threshold satisfies a predetermined condition, that the detection area has been detected in the period.

In the above-mentioned printer according to the one embodiment of the present invention, wherein the detection unit is configured to: calculate the integrated value each time the acquisition unit acquires the detection signal at the predetermined interval; and set the integrated value to a specific value when a calculation result of the integrated value is a negative value.

In the above-mentioned printer according to the one embodiment of the present invention, wherein the specific value comprises one of zero and a positive value set in advance.

According to one embodiment of the present invention, there is provided a detection method, including: conveying, by a conveying unit, a sheet having a detection area on at least a portion of a sheet surface; acquiring, by an acquisition unit, at a predetermined interval in accordance with conveyance of the sheet, a detection signal output from a sensor in accordance with a surface of the sheet conveyed by the conveying unit; and detecting, by a detection unit, the detection area based on an integrated value of a change amount of the detection signal acquired at the predetermined interval in the acquiring.

DETAILED DESCRIPTION OF THE PREFERRED EMBODIMENTS

One embodiment of the present invention is now described with reference to the drawings. First, a schematic configuration of a printer 1 according to this embodiment is described. The printer 1 is, for example, a thermal printer configured to perform printing on a recording sheet (thermal paper), in which a paper cover is connected in an openable/closable manner to a casing configured to accommodate a roll sheet so that the roll sheet may be easily set.

Figure 1:
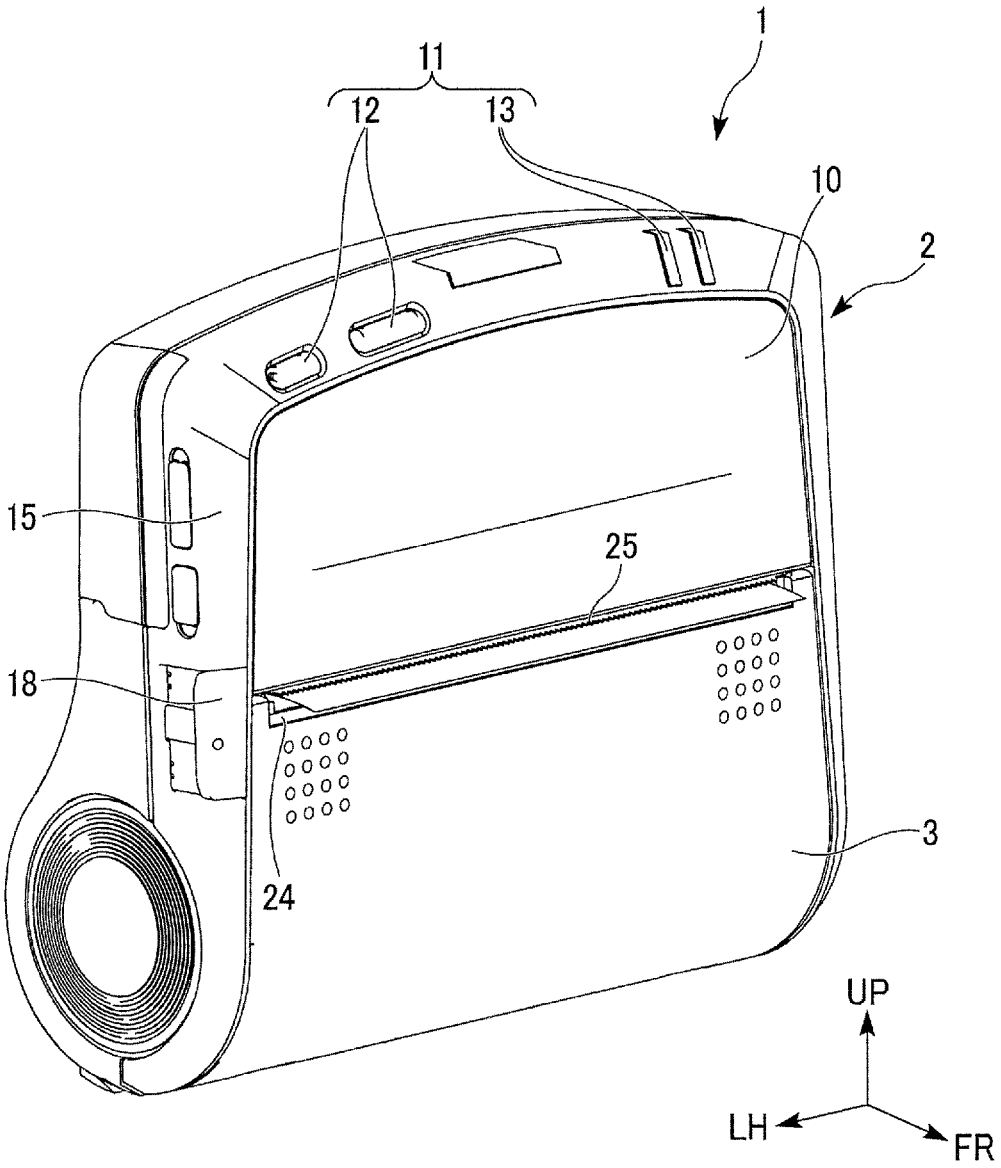
FIG. 1 is a perspective view of a printer, for illustrating a state in which a paper cover takes a closed position.
Figure 2:
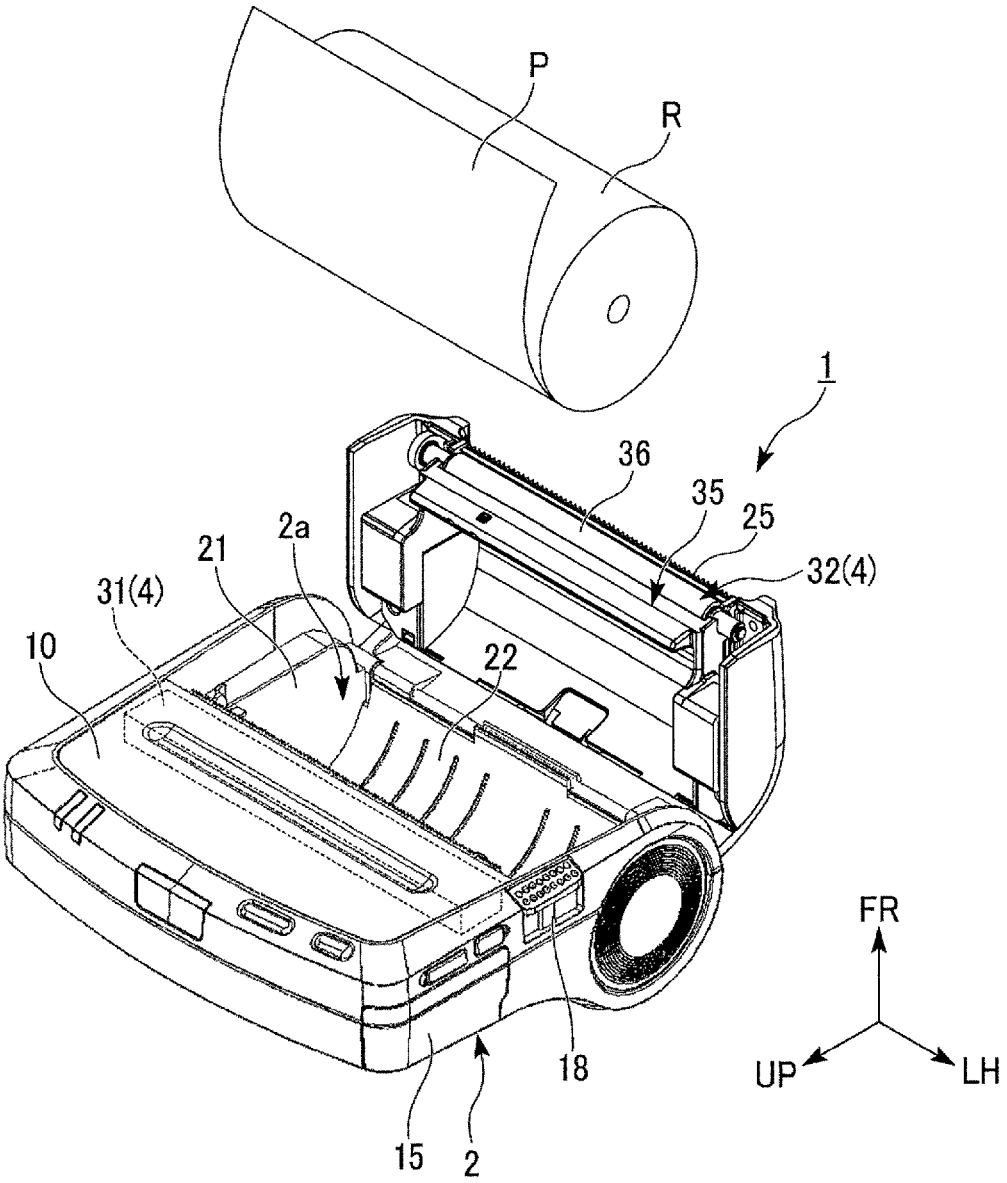
FIG. 2 is a perspective view of the printer, for illustrating a state in which the paper cover takes an opened position.

FIG. 1 is a perspective view of the printer 1, for illustrating a state in which a paper cover 3 takes a closed position. FIG. 2 is a perspective view of the printer 1, for illustrating a state in which the paper cover 3 takes an opened position. In the following description, for easy understanding of the invention, the illustrations are simplified, for example, by omitting a part of structural components, simplifying shapes of the structural components, and modifying scales of the structural components, as appropriate. Further, in the drawings, FR represents a forward direction. LH represents a leftward direction. UP represents an upward direction. The printer 1 may be used while being carried around by a user, and hence the upward/downward direction of the printer 1 may not be fixed. However, in the diagrams of this embodiment, the directions are as defined above.

As illustrated in FIG. 1 and FIG. 2, the printer 1 includes a casing 2 being a housing. The casing 2 has an opening portion 2*a* formed therein. The printer 1 further includes a paper cover 3 serving as an opening and closing cover configured to open and close the opening portion 2*a*. The paper cover 3 is rotatably supported by the casing 2. The printer 1 further includes a printing unit 4 received in the casing 2.

The casing 2 is made of a resin material, e.g., polycarbonate, or a metal material. An upper portion of the casing 2 is formed into a rectangular parallelepiped shape having a front wall 10, whereas a lower portion of the casing 2 is formed into a box shape having the opening portion 2*a* being opened forward. An operation unit 11 configured to perform various operations of the printer 1 is arranged on an upper portion of the front wall 10 of the casing 2. As the operation unit 11, various function switches 12 and various lamps 13 are arranged. The function switches 12 include a power switch, a FEED switch, or other switches. The lamps 13 are arranged adjacent to the function switches 12 and include a POWER lamp for notifying information on an ON/OFF state of the power switch, an ERROR lamp for notifying the error or the like of the printer 1, or other lamps. Further, an open button 18 for opening the paper cover 3 is arranged between the front wall 10 and a side wall 15 of the casing 2.

In the lower portion of the casing 2, there is defined a roll sheet receiving portion 21 for receiving a roll sheet R through the opening portion 2*a*. The roll sheet receiving portion 21 includes a guide plate 22 for holding the roll sheet R, and is configured to hold the roll sheet R between the guide plate 22 and an inner surface of the paper cover 3 so as to cover the roll sheet R. The guide plate 22 has an arc-shaped cross section when viewed in the rightward and leftward directions. The guide plate 22 is configured to hold the roll sheet R under a state in which an outer peripheral surface of the roll sheet R is held in contact with an inner peripheral surface of the guide plate 22, and to guide a sheet P drawn out from the roll sheet R to the printing unit 4. The sheet P employed in this embodiment is a heat sensitive paper and suitably used for printing of various types of labels, receipts, and tickets and the like. This sheet P forms the roll sheet R having a hollow hole by being wound into a roll. Further, the printing unit 4 is configured to perform printing on a region of the sheet P, which is drawn out from the roll sheet R.

The paper cover 3 is made of a resin material, e.g., polycarbonate. A hinge structure (not shown) configured to pivotally support the paper cover 3 is formed in the lower portion of the paper cover 3. The paper cover 3 is rotatable with respect to the casing 2 by virtue of the hinge structure. The hinge structure is funned such that a hinge shaft arranged in the casing 2 and a hinge plate arranged in the paper cover 3 are rotatably supported. Further, the paper cover 3 is formed such that an upper end thereof is lockable with the casing 2 through intermediation of a platen unit 32 described later. Through push of the open button 18, the casing 2 and the paper cover 3 are unlocked, and the paper cover 3 rotates from the closed position illustrated in FIG. 1 to the opened position illustrated in FIG. 2. Further, under the state in which the paper cover 3 takes the closed position, a clearance formed between an upper end edge of the paper cover 3 and a lower end edge of the front wall 10 of the casing 2 serves as a delivery slot 24 through which the sheet P to be printed by the printing unit 4 is delivered.

Cutting blades 25, which are configured to cut the sheet P delivered through the delivery slot 24, are arranged at an opening edge of the delivery slot 24. The cutting blades 25 are integrally arranged at the lower end edge of the front wall 10 of the casing 2 (portion of the opening edge located on its upper side), and at the upper end edge of the paper cover 3, respectively. The sheet P is pulled and moved toward the cutting blades 25 so that the sheet P is cut.

The printing unit 4 includes a head unit 31 and the platen unit 32. The head unit 31 is arranged in a lower end portion of the front wall 10 of the casing 2. The platen unit 32 is arranged in an upper end portion of the paper cover 3 and is removably coupled to the head unit 31 in accordance with an opening and closing operation of the paper cover 3. As illustrated in FIG. 2, the platen unit 32 includes a platen frame 35 being a platen support member, which is mounted to the paper cover 3, and a platen roller 36 rotatably supported by the platen frame 35.

Figure 3:
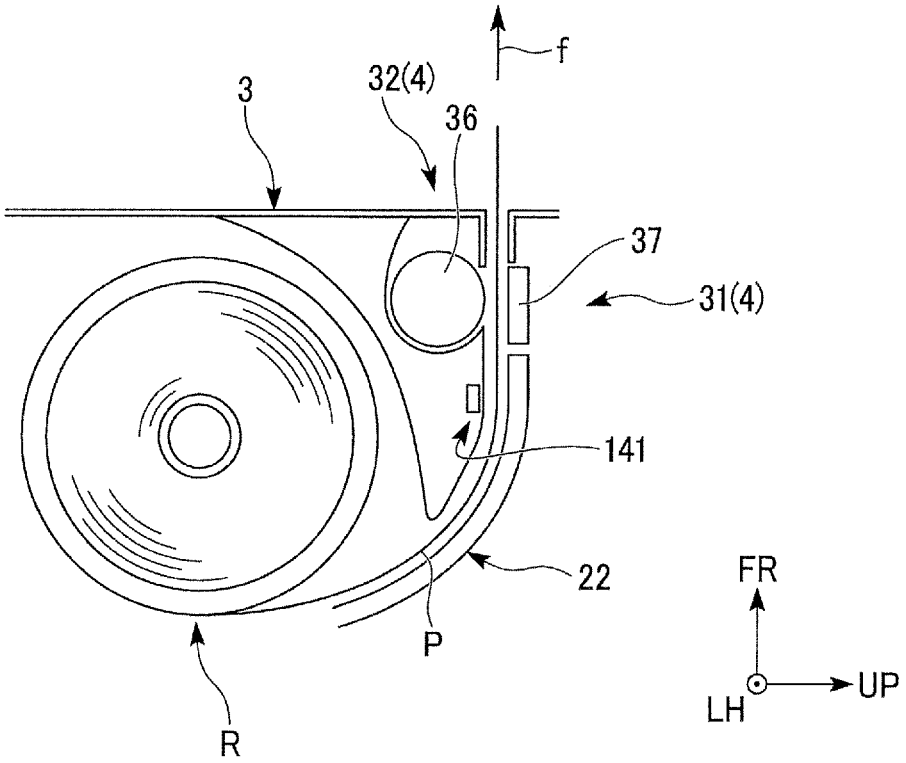
FIG. 3 is a schematic diagram of parts of the printer including a roll sheet receiving portion, a head unit, and a platen unit.

FIG. 3 is a schematic diagram of parts of the printer 1 including the roll sheet receiving portion 21, the head unit 31, and the platen unit 32. In FIG. 3, there is illustrated a state in which the sheet P drawn from the roll sheet R has been conveyed as far as the printing unit 4 under a state in which the paper cover 3 takes an opened position. The platen roller 36, which is driven and rotated by a platen motor 131 described later, is configured to convey the sheet P drawn from the roll sheet R in the direction of an arrow f along the guide plate 22 at a predetermined pitch (e.g., at every dot line). The sheet P is conveyed between the platen roller 36 and a thermal head 37, which is included in the head unit 31, and printing is performed on the sheet P by the thermal head 37. A mark sensor 141 configured to detect a mark provided on the sheet P is arranged upstream from the position at which the sheet P passes between the platen roller 36 and the thermal head 37. The mark is a detection area for determining a printing position (printing start position) on the sheet P. The mark may be, for example, a black object having a predetermined shape printed at a predetermined position on a back surface of the sheet P, which is a blank sheet.

Figure 4:
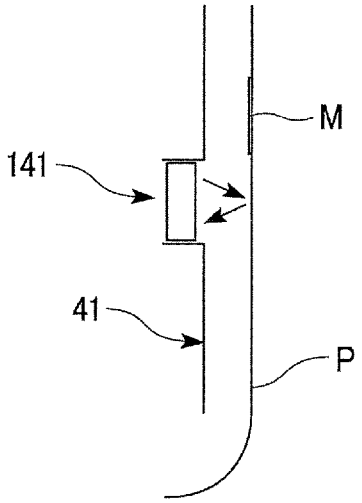
FIG. 4 is a schematic diagram for illustrating an example of a mark sensor.

FIG. 4 is a schematic diagram for illustrating an example of the mark sensor 141. The mark sensor 141 is supported by a guide 41 at a position facing the sheet P being conveyed. For example, the mark sensor 141 is a reflective photoelectric sensor including a light emitting element and a light receiving element. Light from the light emitting element is radiated on an opposite surface to the printing surface of the sheet P (hereinafter also referred to as "back surface"), and the light reflected from the back surface is received by the light receiving element. The mark sensor 141 is configured to output a detection signal (analog signal) having a voltage in accordance with the amount of light received by the light receiving element. Of the back surface of the sheet P, the amount of reflected light from a portion in which a mark M is provided (e.g., a black portion) and the amount of reflected light from a portion other than that portion (e.g., a blank sheet portion) are different, and hence the mark M of the sheet P being conveyed may be detected.

The mark M may be printed in advance on the back surface of the sheet P, or the printer 1 may include a function for printing the mark (e.g., a stamp function), and the mark may be printed on the back surface of the sheet P using that function before printing. In this embodiment, there is described a configuration example in which the mark M is provided on the back surface of the sheet P. However, the mark M may be provided on the printing surface. When the mark M is provided on the printing surface, the mark sensor 141 is arranged at a position for detecting the printing surface side.

Figure 5:
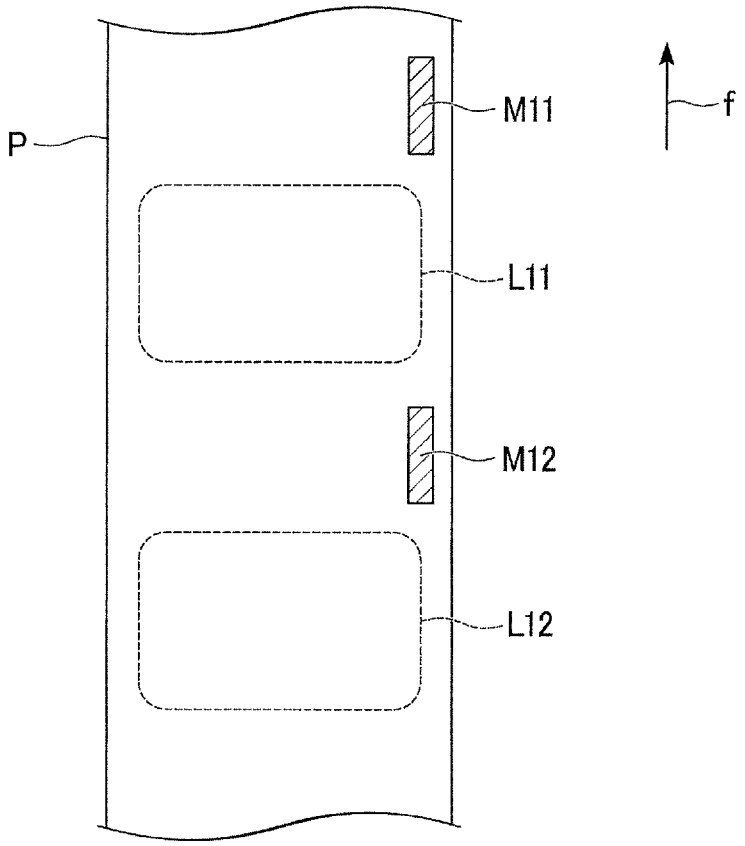
FIG. 5 is a diagram for illustrating a first example of a mark provided on a sheet.
Figure 6:
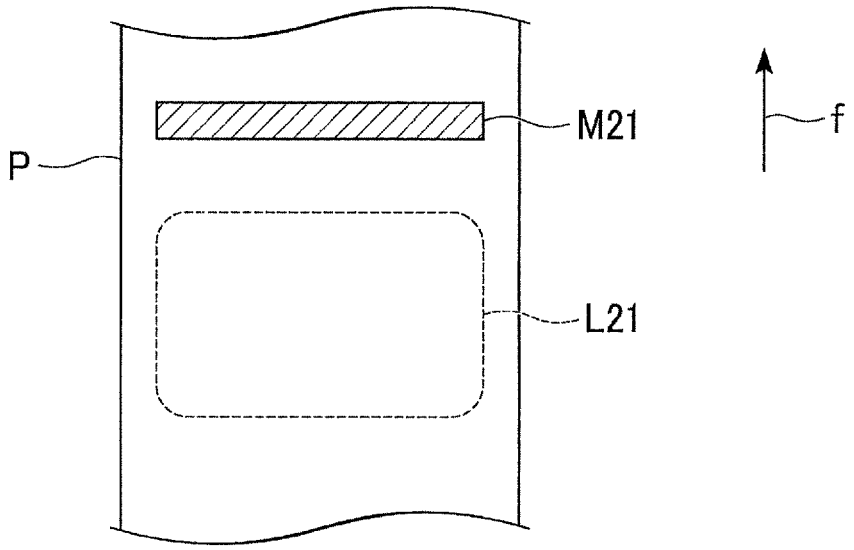
FIG. 6 is a diagram for illustrating a second example of a mark provided on a sheet.
Figure 7:
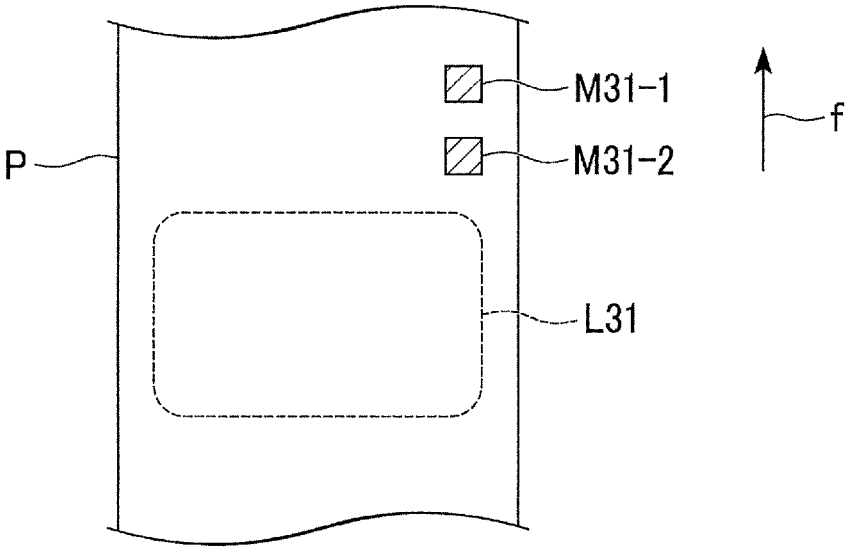
FIG. 7 is a diagram for illustrating a third example of a mark provided on a sheet.

Each of FIG. 5 to FIG. 7 is a diagram for illustrating an example of the mark provided on the sheet P. In each diagram, the back surface of the sheet P is shown. In the example illustrated in FIG. 5, a mark M11, a mark M12, . . . , which are rectangular marks having a longer length in the conveyance direction, are provided on an edge in one direction of the back surface of the sheet P. A label L11, a label L12, . . . to be printed are peelably provided on the printing surface of the sheet P. In the example illustrated in FIG. 5, such a positional relation that the label L11 corresponds to the mark M11 and the label L12 corresponds to the mark M12 is determined in advance. The printer 1 is configured to detect the mark M11 as the sheet P is conveyed in the direction of the arrow f, and to control the printing position on the label L11 based on the position of the detected mark M11. The printer 1 is also configured to detect the mark M12 as the sheet P is further conveyed in the direction of the arrow f, and to control the printing position on the label L12 based on the position of the detected mark M12. As a result, the printer 1 is capable of printing on the appropriate position for each label.

The shape and number of the marks may be arbitrarily determined. For example, in FIG. 6, there is illustrated an example in which a mark M21, . . . , which is a rectangular mark having a longer length in a direction orthogonal to the conveyance direction (i.e., width direction of sheet P), is provided on the back surface of the sheet P. Like the mark M21 illustrated in FIG. 6, the mark is not limited to being provided on an edge of the sheet P, and may also be provided in a manner extending across the width direction of the sheet P. The printer 1 is configured to control the printing position on the label L21 by detecting the mark M21 as the sheet P is conveyed in the direction of the arrow f, to thereby enable printing at the appropriate position.

In FIG. 7, there is illustrated an example in which the mark corresponding to one label is formed of a plurality of marks. In the example illustrated in FIG. 7, two roughly square marks, namely, a mark M31 and a mark M32, are provided on the edge in one direction of the back surface of the sheet P as the marks corresponding to a label L31. The printer 1 is configured to control the printing position on the label L31 by detecting the marks M31 and M32 as the sheet P is conveyed in the direction of the arrow f, to thereby enable printing at the appropriate position.

Next, there is described an example of an AD value obtained by AD-conversion of the detection signal output by the mark sensor 141 in accordance with conveyance of the sheet P in the direction of the arrow f. For example, the printer 1 conveys the sheet P at a predetermined pitch (e.g., at every dot line), and calculates the AD value of the detection signal output by the mark sensor 141 at every predetermined pitch.

Figure 8:
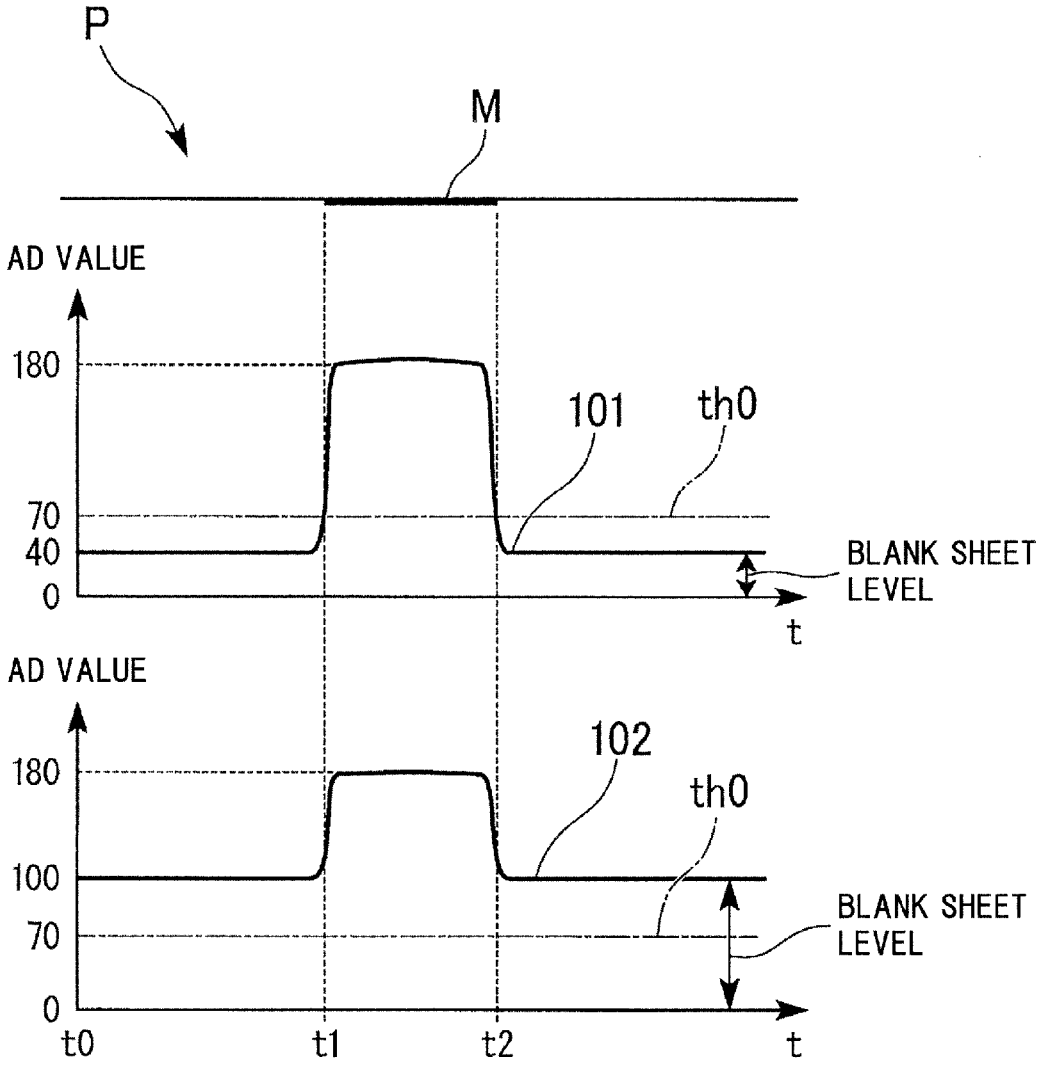
FIG. 8 is graphs for showing examples of an AD value of a mark detection signal.

FIG. 8 is graphs for showing examples of the AD value of the detection signal output by the mark sensor 141. In this case, the mark sensor 141 is configured to output a detection signal having a higher voltage when the amount of received light is smaller, and to output a detection signal having a lower voltage when the amount of received light is larger. In other words, the AD value is higher for an area in which there is a low level of reflected light from the sheet P (mark portion having low reflectance), and the AD value is lower for an area in which there is a high level of reflected light from the sheet P (blank sheet portion having high reflectance). The AD value may be, for example in the case of an 8-bit value, any value between "0 to 255".

In FIG. 8, the vertical axis represents the AD value, and the horizontal axis represents a time (t). A reference numeral 101 represents an example (first example) of the detection signal output from the mark sensor 141 at every predetermined pitch. In the first example, the AD value for a period in which the blank sheet portion other than the mark of the sheet P is detected (i.e., from time t0 to time t1, and from time t2 onward) is lower (e.g., "40"), and the AD value for a period in which the mark portion of the sheet P is detected (i.e., from time t1 to time t2) is higher (e.g., "180"). However, when a white level (i.e., level of whiteness of the sheet), a color hue (tinge of the sheet), or the like of the blank sheet portion other than the mark of the sheet P changes due to a change in the sheet P, for example, the reflectance of that portion changes, which causes the AD value to change. A reference numeral 102 represents an example (second example) of the AD value when the reflectance of the blank sheet portion other than the mark of the sheet P is lower than that in the first example. In the second example, the AD value during the period in which the mark portion is detected is the same, but the AD value during the period in which the blank sheet portion other than the mark is detected is a higher value (e.g., "100") than that in the first example. In the following description, the AD value when the blank sheet portion is detected is also referred to as "blank sheet level".

Thus, a difference occurs in the blank sheet level depending on the reflectance of the blank sheet portion other than the mark of the sheet P. As a result, in the related-art detection method, for example, the mark may be detected in the above-mentioned first example (i.e., AD value represented by reference numeral 101 in FIG. 8) by setting a mark detection judgment threshold th0 to "70", but in the case of the second example (i.e., AD value represented by reference numeral 102 in FIG. 8), in which the sheet P has been changed, when the judgment threshold th0 is used as it is, not only the AD value of the mark portion, but the AD value (blank sheet level) of the blank sheet portion other than the mark also exceeds the judgment threshold th0, and as a result, it is impossible to detect the mark. Therefore, in the related-art detection method, when the reflectance of the blank sheet portion other than the mark of the sheet P changes due to a change in the sheet P or the like, the blank sheet level changes, and there may be a need to reset the judgment threshold th0 each time such a change occurs.

In this embodiment, threshold judgment is performed by using an integrated value obtained by integrating a change amount of the AD value of the detection signal from the mark sensor 141. Thus, the mark may be detected without resetting the judgment threshold even when the reflectance of the blank sheet portion other than the mark of the sheet P changes due to a change in the sheet P or the like. A method of detecting the mark by using the integrated value of the change amount of the AD value is now described with reference to FIG. 9.

Figure 9:
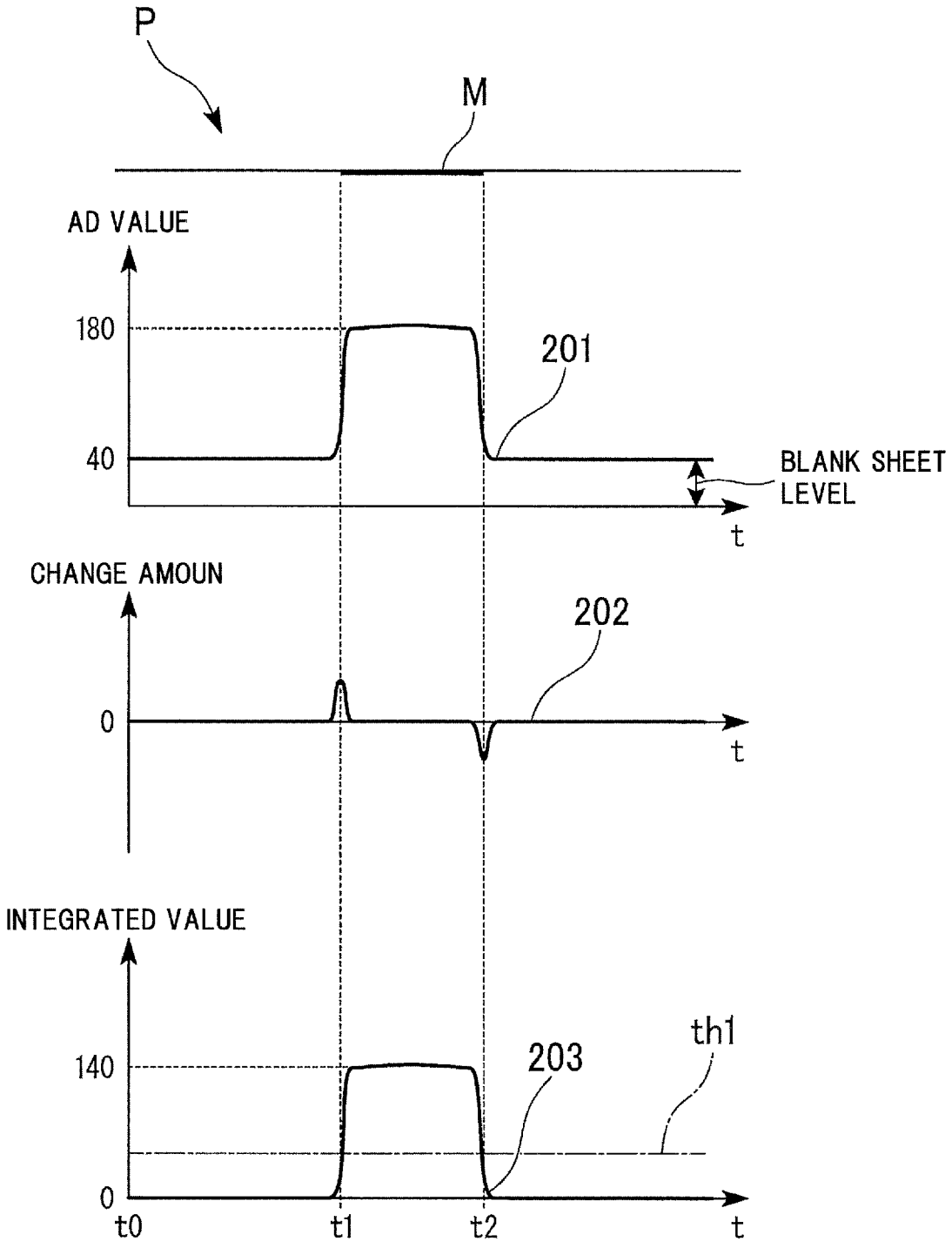
FIG. 9 is graphs for showing an example of an AD value, change amount, and integrated value of a mark detection signal.

FIG. 9 is graphs for showing an example of the AD value output by the mark sensor 141, the change amount of that AD value, and the integrated value of that change amount. In FIG. 9, the vertical axis represents the AD value, the change amount, and the integrated value, and the horizontal axis represents a time (t). A reference numeral 201 represents an example of the AD value of the detection signal output from the mark sensor 141 at every predetermined pitch. The reference numeral 201 corresponds to the first example represented by the reference numeral 101 of FIG. 8.

A reference numeral 202 represents the change amount of the AD value at every predetermined pitch. The change amount may be determined by calculating, at every predetermined pitch, a difference between the AD value obtained the previous time and the AD value obtained this time. For example, before detection starts, the integrated value is set at first to "0". During the period in which the blank sheet portion other than the mark of the sheet P is detected (i.e., from time t0 to time t1), the AD value (e.g., "40") does not change, and hence the change amount of the AD value remains at "0". Next, when the mark portion of the sheet P is detected (i.e., time t1), the AD value changes (e.g., from "40" to "180"), and hence during the period from the start until the end of the change in the AD value, the change amount of the AD value becomes a positive value in accordance with the change. After the change in the AD value has ended, during the period in which the mark portion of the sheet P is detected (i.e., from time t1 to time t2), the AD value (e.g., "180") does not change, and hence the change amount of the AD value becomes "0". Next, when detection of the mark portion of the sheet P ends and the blank sheet portion is detected (i.e., time t2), the AD value changes (e.g., from "180" to "40"), and hence during the period from the start until the end of the change in the AD value, the change amount of the AD value becomes a negative value in accordance with the change. After the change in the AD value has ended, during the period in which the blank sheet portion other than the mark of the sheet P is detected (i.e., time t2 onward), the AD value (e.g., "40") does not change, and hence the change amount of the AD value becomes "0".

A reference numeral 203 represents the integrated value obtained by integrating, at every predetermined pitch, the change amount of the AD value represented by the reference numeral 202. The integrated value during the period in which the blank sheet portion other than the mark of the sheet P is detected (i.e., from time t0 to time t1, and from time t2 onward) is "0", and the integrated value during the period in which the mark portion of the sheet P is detected (i.e., from time t1 to time t2) becomes an integrated value (e.g., "140") in accordance with the change amount. In FIG. 9, the integrated value of the change amount of the AD value in the case of the first example shown in FIG. 8 is shown. However, even in the case of the second example shown in FIG. 8, the integrated value during the period in which the blank sheet portion other than the mark of the sheet P is detected is "0". In other words, the integrated value of the blank sheet portion other than the mark of the sheet P is "0" regardless of the blank sheet level. Therefore, the judgment threshold for detecting the mark is not influenced by the blank sheet level, and hence may be set to a lower value than when judging based on the AD value.

For example, in the example shown in FIG. 9, there is shown an example in which the judgment threshold th1 is set to "40" as a threshold capable of distinguishing between the integrated value "0" during the period in which the blank sheet portion other than the mark is detected and the integrated value (e.g., "140") during the period in which the mark portion is detected. As long as the judgment threshold th1 is set to that value, even when the blank sheet level increases, for example, in the second example (i.e., AD value represented by reference numeral 102) of FIG. 8, the integrated value during the period in which the blank sheet portion other than the mark is detected is "0", and the integrated value during the period in which the mark portion is detected is "80", and hence the mark may be detected.

Figure 10:
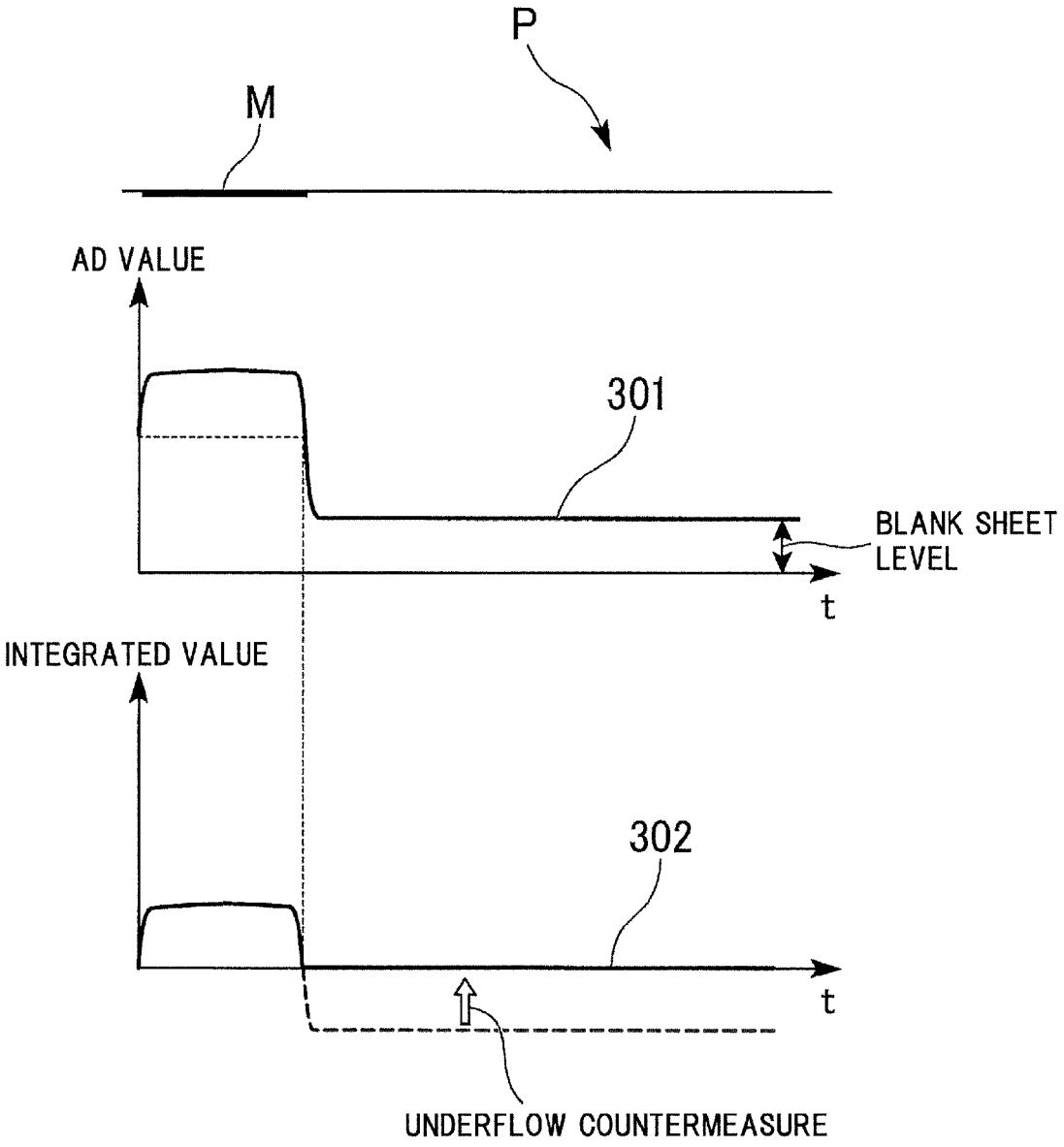
FIG. 10 is explanatory graphs of an underflow countermeasure.

The integrated value of the change amount of the AD value may become negative depending on the start position of mark detection on the sheet P. Therefore, the printer 1 is configured to perform an underflow countermeasure. FIG. 10 is explanatory graphs of an underflow countermeasure. In FIG. 10, a reference numeral 301 represents an example of the AD value of the detection signal output from the mark sensor 141 at every predetermined pitch. A reference numeral 302 represents the integrated value that the underflow countermeasure has been applied to. As shown in FIG. 10, for example, when AD value detection is started from a position that is not at the blank sheet level, the integrated value is set to "0" based on the AD value of the position at which detection started at as a reference, and hence the negative change amount is greater than the positive change amount, and the integrated value may become negative. For example, when the integrated value at the blank sheet level becomes negative, the integrated value may not exceed the judgment threshold even during the next period in which the mark portion is to be detected, and hence the mark cannot be detected. Therefore, the printer 1 is configured to perform the underflow countermeasure to limit the integrated value to "0" so that the integrated value does not become negative. As a result, the level at which the integrated value becomes "0" follows the minimum level (i.e., blank sheet level) of the AD value, and hence the integrated value is always at "0" when the AD value is at the blank sheet level, to thereby remove a bias component due to the blank sheet level. Therefore, the printer 1 is capable of correctly detecting the mark to be detected next in accordance with conveyance of the sheet P.

Figure 11:
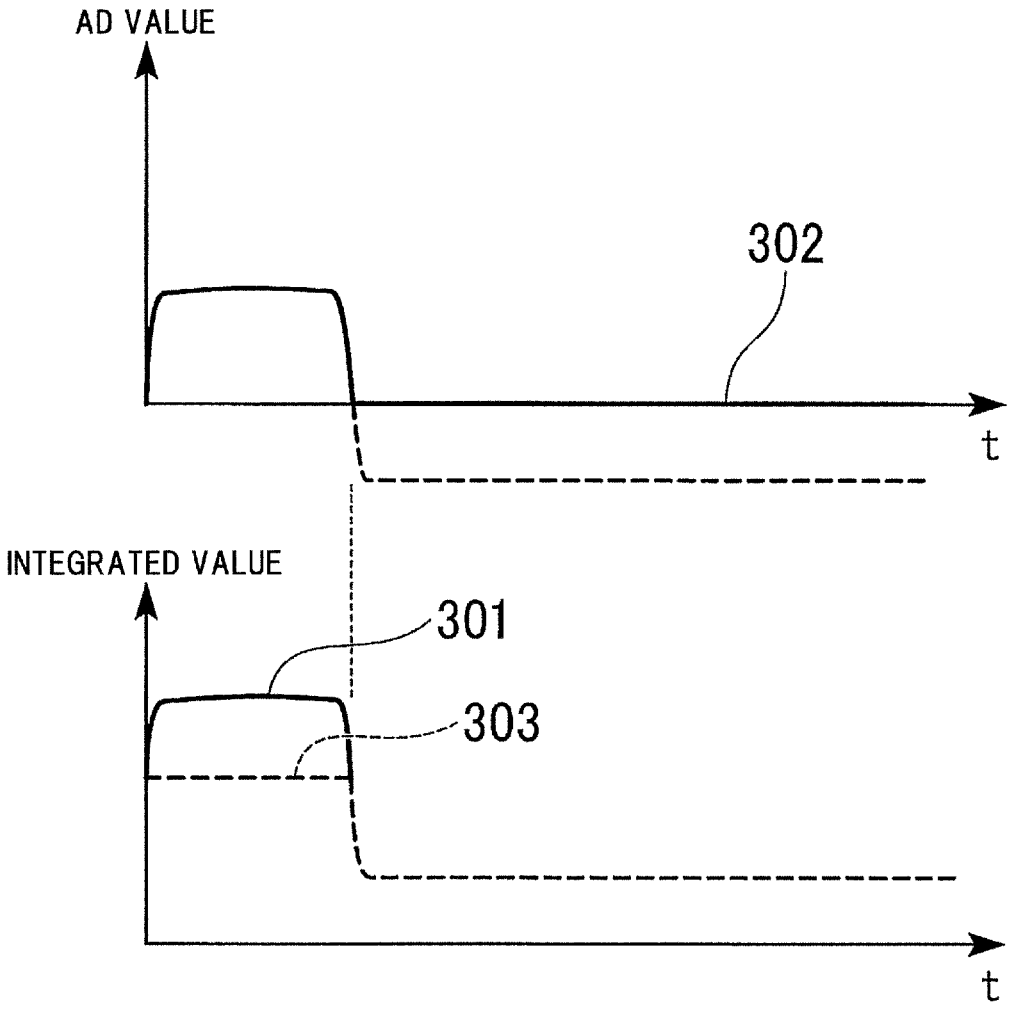
FIG. 11 is graphs for showing how a blank sheet level follows the underflow countermeasure.

FIG. 11 is graphs for showing how the blank sheet level follows the underflow countermeasure. Similarly to FIG. 10, the reference numeral 301 represents an example of the AD value of the detection signal output from the mark sensor 141 at every predetermined pitch, and the reference numeral 302 represents the integrated value that the underflow countermeasure has been applied to. In the integrated value that the underflow countermeasure has been applied to, the level of the AD value at which the integrated value becomes "0" changes (i.e., follows the underflow countermeasure) as time proceeds. A reference numeral 303 represents the level at which the integrated value that changes (i.e., follows the underflow countermeasure) as time proceeds becomes "0" superimposed on the AD value represented by reference numeral 301.

Thus, in this embodiment, the printer 1 is configured to use the integrated value of the change amount of the AD value output from the mark sensor 141, and hence the printer 1 is capable of easily detecting the mark, even when the blank sheet level changes due to the type of sheet P, without resetting the judgment threshold each time the blank sheet level changes. For example, the printer 1 may perform mark detection with a relative threshold set for the blank sheet level by performing a threshold judgment on the integrated value. Further, the judgment threshold th1 may be set to a low level without being influenced by fluctuations in the blank sheet level of the sheet P, and hence a mark having a faint density may be detected, and the required specification for mark reflectance may be relaxed. As a result, production costs of the mark may be suppressed. In addition, the calculation of the integrated value may be performed based on simple processing executed by software, and hence the hardware does not need to be added to or changed, which not only allows costs to be suppressed, but also enables an existing device to be easily replaced or modified.

Figure 12:
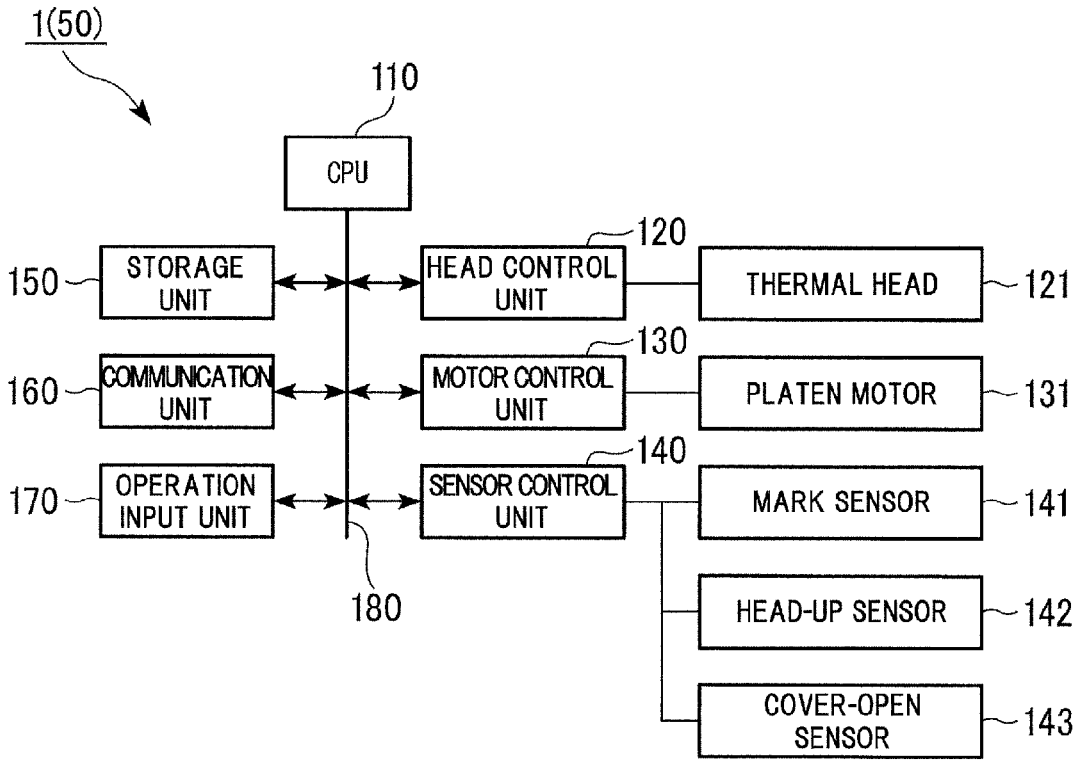
FIG. 12 is a block diagram for illustrating an example of a hardware configuration of the printer.

Next, the configuration of the printer 1 according to this embodiment is described. FIG. 12 is a block diagram for illustrating an example of the hardware configuration of the printer 1 according to this embodiment. The printer 1 includes a CPU 110, a head control unit 120, a motor control unit 130, a sensor control unit 140, a storage unit 150, a communication unit 160, and an operation input unit 170. Those units are connected to each other via a bus 180.

The CPU 110 is constructed from a central processing unit (CPU), and is configured to control each of the units of the printer 1. The head control unit 120 is configured to control, under the control of the CPU 110, a drive of a thermal head 121, which is configured to perform printing on the sheet P. The motor control unit 130 is configured to drive, under the control of the CPU 110, the platen motor 131 to cause the platen roller 36 to rotate, to thereby convey the sheet P at the predetermined pitch (e.g., at every dot line).

The sensor control unit 140 is configured to acquire, under the control of the CPU 110, the detection signal output by the mark sensor 141, and to output the acquired detection signal to the CPU 110. The sensor control unit 140 is also configured to detect, under the control of the CPU 110, whether or not the thermal head 121 is up by using a head-up sensor 142, and to output a detection result to the CPU 110. The sensor control unit 140 is also configured to detect, under the control of the CPU 110, opening and closing of the paper cover 3 by using a cover-open sensor 143, and to output a detection result to the CPU 110. The printer 1 may include any one of, or both of, the head-up sensor 142 and the cover-open sensor 143.

The storage unit 150 includes, as a storage medium, for example, a read-only memory (ROM), a random-access memory (RAM), or the like. The storage unit 150 may also include a hard disk drive (HDD), a flash memory, or the like. The storage unit 150 is configured to store, for example, a program to be executed by the CPU 110, and data required when the CPU 110 executes that program. The storage unit 150 is also configured to store the detection result of the mark sensor 141 and others.

The communication unit 160, which is communicably connected to a host device (not shown), is configured to receive data input from the host device, and to output to the CPU 110 control commands and various data included in the input data. The operation input unit 170 is configured to generate an operation signal in accordance with an operation performed on the operation unit 11, and to output the generated operation signal to the CPU 110.

In FIG. 12, a detection device 50 may include a portion of the above-mentioned various units included in the printer 1. For example, the detection device 50 may include parts corresponding to the CPU 110, the motor control unit 130, the platen motor 131, the sensor control unit 140, the mark sensor 141, and the storage unit 150. The detection device 50 may be configured to convey some kind of sheet, and to detect a mark provided on a conveyed sheet.

Figure 13:
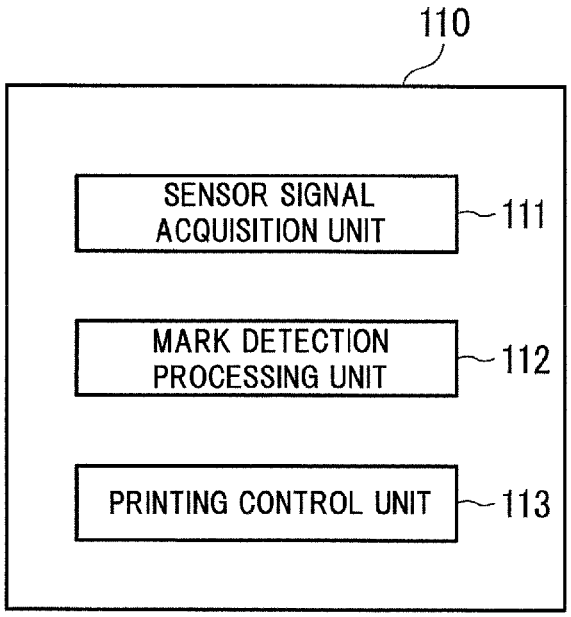
FIG. 13 is a block diagram for illustrating an example of function configurations to be executed by a CPU.

FIG. 13 is a block diagram for illustrating an example of the function configurations to be executed by the CPU 110. The printer 1 includes, as function configurations to be executed by the CPU 110 based on programs and data stored in the storage unit 150, a sensor signal acquisition unit 111, a mark detection processing unit 112, and a printing control unit 113.

The sensor signal acquisition unit 111 is configured to acquire, via the sensor control unit 140, the detection signal output from the mark sensor 141, which is configured to output the detection signal in accordance with the back surface of the sheet P being conveyed. For example, the sensor signal acquisition unit 111 is configured to acquire the detection signal output from the mark sensor 141 at the predetermined pitch (e.g., at every dot line) in accordance with the conveyance of the sheet P. The sensor signal acquisition unit 111 is also configured to store the AD value obtained by AD-conversion of the acquired detection signal in the storage unit 150 in a manner that allows the AD values to be specified in the order in which the detection signals were acquired. The sensor signal acquisition unit 111 is configured to set an interval for acquiring the detection signal output from the mark sensor 141 such that the interval completely matches an interval for conveying the sheet P, or does not completely match the interval for conveying the sheet P. The sensor signal acquisition unit 111 is also configured to issue a detection request at a predetermined timing to each of the head-up sensor 142 and the cover-open sensor 143, and to acquire a detection result from each of the head-up sensor 142 and the cover-open sensor 143.

The mark detection processing unit 112 is configured to calculate the change amount of the detection signal (AD value) acquired at the predetermined pitch (e.g., at every dot line) by the sensor signal acquisition unit 111. For example, the mark detection processing unit 112 determines the change amount of the AD value by calculating, at every predetermined pitch, the difference between the AD value obtained the previous time and the AD value obtained this time. The mark detection processing unit 112 is also configured to calculate the integrated value of the calculated change amount. The mark detection processing unit 112 is also configured to detect the mark on the back surface of the sheet P based on a comparison result obtained by comparing the calculated integrated value and the judgment threshold th1 (refer to FIG. 9).

For example, the mark detection processing unit 112 calculates the integrated value each time the sensor signal acquisition unit 111 acquires the detection signal at the predetermined pitch (e.g., at every dot line). The mark detection processing unit 112 is also configured to judge, when a period in which the integrated value is continuously equal to or more than the judgment threshold th1 satisfies a predetermined condition, that the mark has been detected in that period. In this case, the predetermined condition is, for example, the fact that the period in which the integrated value is continuously equal to or more than a predetermined threshold corresponds to a prescribed length of the mark. When the period is shorter than the prescribed length or longer than the prescribed length, that period is judged not to correspond to the mark, and hence it is judged that the mark has not been detected. The mark detection processing unit 112 is also configured to output to the printing control unit 113, when the mark is detected, detection information representing the fact that the mark has been detected.

The printing control unit 113 is configured to control the printing position for printing on the sheet P based on the mark detected by the mark detection processing unit 112. For example, when detection information is acquired from the mark detection processing unit 112, the printing control unit 113 determines the printing position based on the acquired detection information. Then, the printing control unit 113 conveys the sheet P and prints on the determined printing position via the thermal head 121, by controlling the motor control unit 130 and the head control unit 120.

Figure 14:
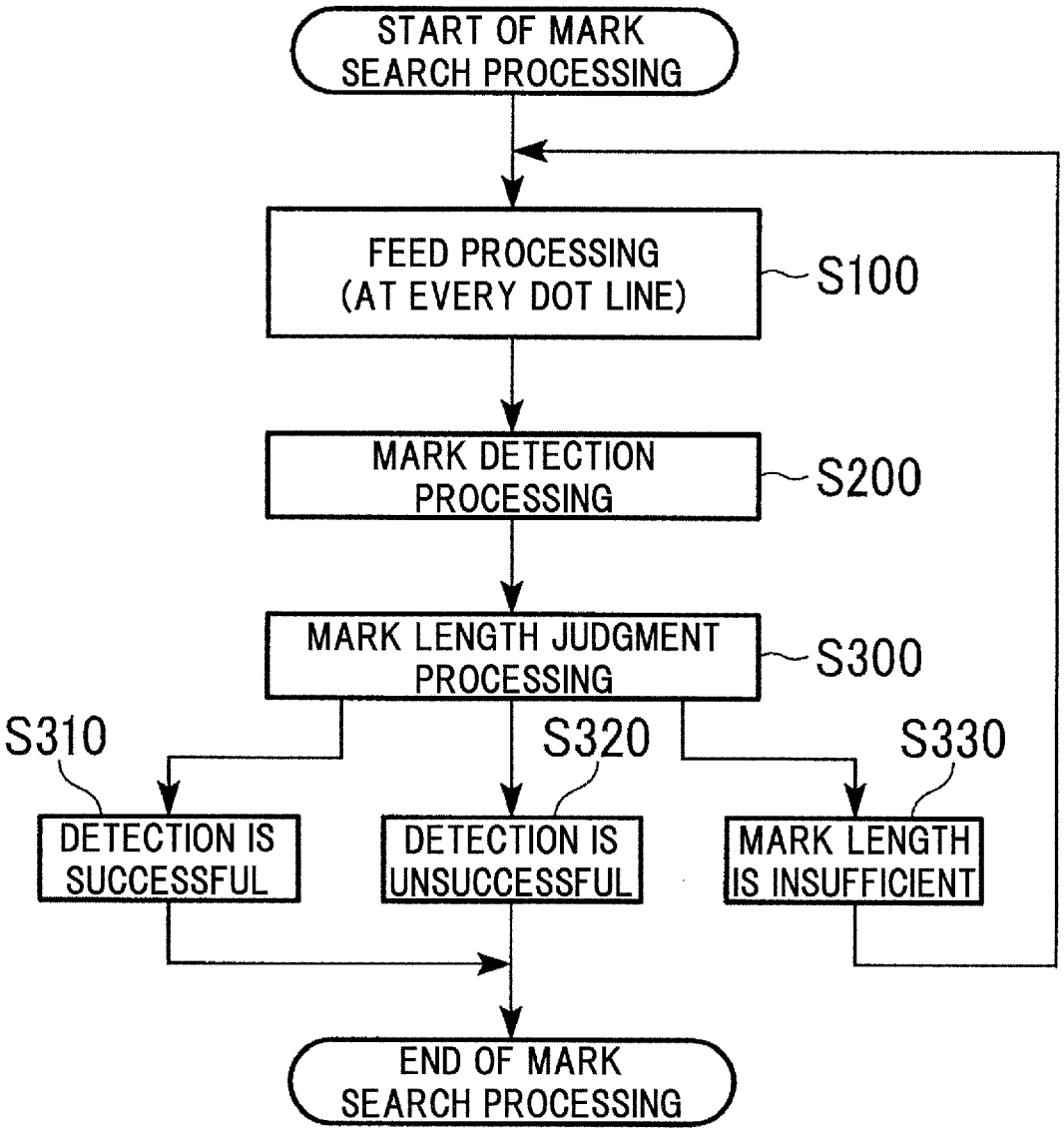
FIG. 14 is a flowchart for illustrating an example of mark search processing.

Next, a mark search processing operation executed by the printer 1 is described with reference to FIG. 14. FIG. 14 is a flowchart for illustrating an example of mark search processing according to this embodiment. The mark search processing refers to processing for searching for the mark provided on the back surface of the sheet P by using mark detection processing in which, as described above, the mark is detected based on an integrated value obtained by integrating the change amount of the AD value of the detection signal from the mark sensor 141.

(Step S100) The CPU 110 conveys, at the predetermined pitch (e.g., at every dot line), the sheet P drawn from the roll sheet R by controlling the motor control unit 130 (i.e., performs feed processing).

(Step S200) The CPU 110 acquires the detection signal from the mark sensor 141 each time the sheet P is conveyed at the predetermined pitch (e.g., at every dot line), and detects the mark based on the integrated value of the change amount of the acquired detection signal (AD value). The mark detection processing is now described in more detail with reference to FIG. 15.

Figure 15:
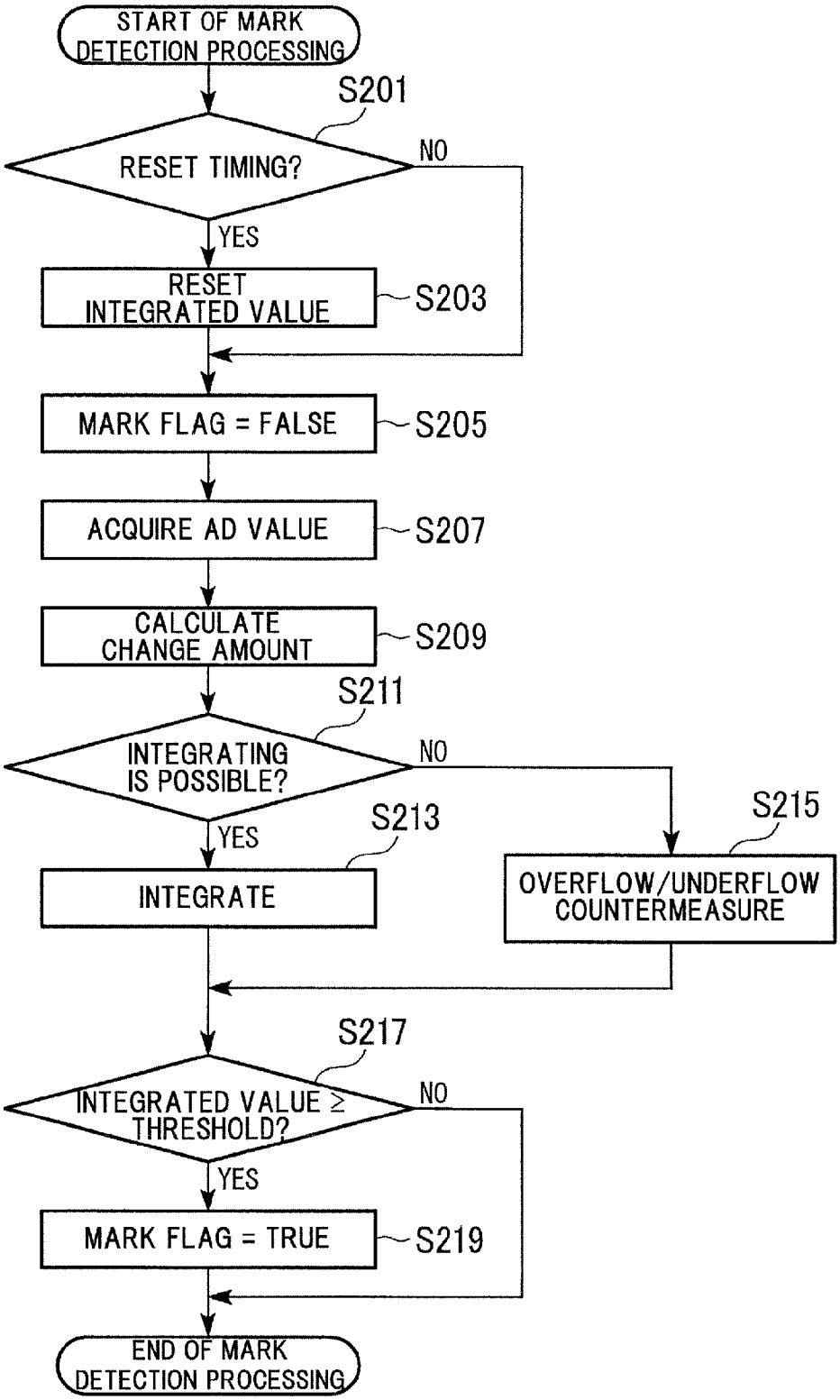
FIG. 15 is a flowchart for illustrating an example of mark detection processing.

FIG. 15 is a flowchart for illustrating an example of the mark detection processing according to this embodiment.

(Step S201) The CPU 110 judges whether or not a reset timing for the integrated value has been reached. Examples of the reset timing for the integrated value include a first detection immediately after a power supply has been turned on and a first detection after recovery from an error state (e.g., out of paper, the paper cover 3 taking an opened position, and the thermal head 121 being at an up position). When it is judged that the reset timing for the integrated value has been reached (YES), the CPU 110 advances the processing to Step S203. On the other hand, when it is judged that the reset timing for the integrated value has not been reached (NO), the CPU 110 advances the processing to Step S205.

(Step S203) The CPU 110 resets the integrated value (i.e., sets the integrated value to "0"), and then advances the processing to Step S205. In this manner, a new blank sheet level can be automatically handled and effort involved with resetting of the judgment threshold can be skipped by setting the reset timing for the integrated value to, for example, the first detection immediately after the power supply has been turned on or the first detection after recovery from an error state (e.g., out of paper, the paper cover 3 taking an opened position, and the thermal head 121 being at an up position).

(Step S205) The CPU 110 sets a mark flag to "False". The mark flag is flag information representing a detection state of the mark sensor 141. When the mark flag is "False", this means that the mark sensor 141 is detecting a blank sheet portion other than the mark. On the other hand, when the mark flag is "True", this means that the mark sensor 141 is detecting the mark portion. The CPU 110 then advances the processing to Step S207.

(Step S207) The CPU 110 acquires the detection signal (AD value) output from the mark sensor 141 via the sensor control unit 140, and then advances the processing to Step S209.

(Step S209) The CPU 110 calculates, based on the acquired detection signal (AD value), the change amount of the AD value by calculating the difference between the AD value obtained the previous time and the AD value obtained this time. There is no previous AD value only in a first detection, and hence in Step S207, two detection signals (AD values) may be consecutively obtained to calculate the difference between those two detection signals. The CPU 110 then advances the processing to Step S211.

(Step S211) The CPU 110 judges whether or not the change amount calculated in Step S209 can be integrated. Specifically, the CPU 110 judges that the change amount can be integrated when an integration result is within a range of from 0 to 255 (for an 8-bit case), and judges that the change amount cannot be integrated when the integration result is not within the "0 to 255" range (i.e., when the integration result is negative, or is a value more than "255").

(Step S213) When it is judged in Step S211 that the change amount can be integrated (YES), the CPU 110 integrates the change amount calculated in Step S209 (i.e., integrates with the integrated values until the previous time), and then advances the processing to Step S217.

(Step S215) When it is judged in Step S211 that the change amount cannot be integrated (NO), the CPU 110 performs an overflow countermeasure or the underflow countermeasure, and then advances the processing to Step S217. For example, when the integration result is a value more than "255", the CPU 110 sets the integrated value to "255" as the overflow countermeasure. On the other hand, when the integration result is negative, the CPU 110 sets the integrated value to "0" as the underflow countermeasure (refer to FIG. 10 and FIG. 11).

(Step S217) The CPU 110 compares the integrated value calculated in Step S213, or the integrated value set in Step S215, and the judgment threshold th1 (refer to FIG. 9), and judges whether or not the integrated value is equal to or more than the judgment threshold th1. When it is judged that the integrated value is less than the judgment threshold th1 (NO), the CPU 110 ends the mark detection processing without changing the mark flag (i.e., mark flag="False").

(Step S219) When it is judged in Step S217 that the integrated value is equal to or more than the judgment threshold th1 (YES), the CPU 110 sets the mark flag to "True", and ends the mark detection processing (i.e., mark flag="True").

Returning to FIG. 14, when the mark detection processing of Step S200 ends, the processing advances to Step S300.

(Step S300) The CPU 110 judges a mark length based on the result of the mark detection processing of Step S200. For example, the CPU 110 judges, based on the result of the mark detection processing, whether or not the period in which the integrated value is continuously equal to or more than the judgment threshold th1 corresponds to the prescribed length of the mark.

(Step S310) When it is judged in Step S300 that the period in which the integrated value is continuously equal to or more than the judgment threshold th1 corresponds to the prescribed length of the mark, the CPU 110 judges that the mark has been detected (i.e., detection is successful), and ends the mark search processing. More specifically, the CPU 110 regards the detected mark as a correct mark only when the period in which the integrated value is continuously equal to or more than the judgment threshold th1 is within a range of from a minimum mark length to a maximum mark length set as the prescribed length of the mark.

(Step S320) When it is judged in Step S300 that the period in which the integrated value is continuously equal to or more than the judgment threshold th1 is longer than the prescribed length of the mark, the CPU 110 judges that the mark is an incorrect mark (i.e., detection is unsuccessful), and ends the mark search processing. More specifically, the CPU 110 regards the detected mark as an incorrect mark when the period in which the integrated value is continuously equal to or more than the judgment threshold th1 exceeds the prescribed length of the mark. Depending on the model of the printer, the printer may not include an out-of-paper detection sensor configured to detect that there are no sheets that have been set. In such a model, when the period in which the integrated value is continuously equal to or more than the judgment threshold th1 exceeds the prescribed length of the mark, it may be judged that the printer is in an out-of-paper state. In other words, the mark sensor 141 may also be used as an out-of-paper detection sensor.

(Step S330) When it is judged in Step S300 that the period in which the integrated value is continuously equal to or more than the judgment threshold th1 is shorter than the prescribed length of the mark (i.e., mark length is insufficient), the CPU 110 returns the processing to Step S100, conveys the sheet P at the predetermined pitch (e.g., at every dot line), and performs mark detection processing on the conveyed position. The processing is also returned to Step S100 when it is judged that the integrated value has not continuously exceeded the judgment threshold th1 since the start of detection.

As described above, the printer 1 (detection device 50) according to this embodiment includes the motor control unit 130 (an example of the conveying unit), the mark sensor 141 (an example of the sensor), the sensor signal acquisition unit 111 (an example of the acquisition unit), and the mark detection processing unit 112 (an example of the detection unit). The motor control unit 130 is configured to convey the sheet P having the mark (an example of the detection area) on at least a portion of the sheet surface. The mark sensor 141 is configured to output the detection signal in accordance with the surface of the sheet P being conveyed. The sensor signal acquisition unit 111 is configured to acquire, at a predetermined interval in accordance with conveyance of the sheet P, the detection signal output from the mark sensor 141. The mark detection processing unit 112 is configured to detect the mark based on the integrated value of the change amount of the detection signal acquired at the predetermined interval by the sensor signal acquisition unit 111. As a result, the printer 1 (detection device 50) may easily detect the detection area provided on the sheet surface. In this embodiment, as the detection area, there is described an example of a black mark having a predetermined shape (e.g., a square) printed on the sheet surface. However, the present invention is not limited to that example. The detection area may have an arbitrary shape or color. In this embodiment, the detection area is referred to as a mark, but the detection area may also be referred to using another term, such as a seal, a symbol, an indication, and a notation.

The mark detection processing unit 112 is configured to calculate the integrated value each time the sensor signal acquisition unit 111 acquires the detection signal at the predetermined interval. The mark detection processing unit 112 is also configured to judge, when the period in which the integrated value is continuously equal to or more than the predetermined threshold (e.g., judgment threshold th1) satisfies a predetermined condition, that the mark has been detected in that period. In this case, the predetermined condition is, for example, the fact that the period in which the integrated value is continuously equal to or more than the predetermined threshold corresponds to a prescribed length of the mark. Specifically, the mark detection processing unit 112 is configured to regard the detected mark as a correct mark only when the period in which the integrated value is continuously equal to or more than the judgment threshold th1 is within a range of from a minimum mark length to a maximum mark length set as the prescribed length of the mark. On the other hand, the mark detection processing unit 112 is configured to judge that no mark has been detected when the period in which the integrated value is continuously equal to or more than the predetermined threshold is less than the period corresponding to the prescribed length of the mark (i.e., is less than the minimum mark length). The mark detection processing unit 112 is also configured to judge that the mark is too long when the period in which the integrated value is continuously equal to or more than the judgment threshold th1 exceeds the period corresponding to the prescribed length of the mark (i.e., exceeds the maximum mark length), and to regard the detected mark as an incorrect mark. As a result, the printer 1 (detection device 50) may avoid an erroneous detection of the mark even when, by some chance, dirt or a contaminant similar to the mark has adhered to the sheet surface.

The predetermined condition is not limited to a condition relating to the prescribed length of the mark. The predetermined condition may be an arbitrary condition set in accordance with a specification of the mark. For example, as in the example illustrated in FIG. 7, when a mark corresponding to one label is formed of a plurality of marks, the detection of a plurality of periods in which the integrated value is continuously equal to or more than the predetermined threshold for those plurality of marks may be set as the predetermined condition.

The mark detection processing unit 112 is configured to set, as an underflow countermeasure, the integrated value to a specific value when the calculation result of the integrated value is a negative value. In this case, the specific value is, for example, "0" (zero). The specific value may also be a positive value (e.g., "1", which is close to "0") set in advance. Setting the integrated value to such a specific value enables the printer 1 (detection device 50) to appropriately detect the mark regardless of the detection start position of the mark on the sheet P. As a result, there is no need to take into consideration the positional relation between the drawn sheet P and the mark detection position when setting the roll sheet R, and hence less effort is required.

The printer 1 includes the printing control unit 113 configured to control the printing position for printing on the sheet P based on the mark detected by the mark detection processing unit 112. This enables the printer 1 to appropriately print in the area to be printed corresponding to the mark.

One embodiment of the present invention is described above. However, the present invention is not limited to the one embodiment described above, and various modifications within a scope that does depart from the gist of the present invention may be added thereto. For example, in this embodiment, there is described an example in which the mark sensor 141 is a reflective sensor. However, the mark sensor 141 may be a transmissive sensor. For example, in the case of a transmissive sensor, the mark sensor 141 is configured such that the detection area of the sheet allows light to pass therethrough.

In this embodiment, there is described an example in which printing is performed on a label sheet. However, the sheet to be printed on may be any kind of sheet. For example, the sheet to be printed on may be an invoice on which a destination address or a sender address for a delivery service is to be printed, or an inspection slip for water or gas. In this embodiment, there is described an example in which the printer 1 is a thermal printer. However, the printing method is not limited to thermal printing. Therefore, the sheet to be printed on is also not limited to thermal paper. The composition and the material of the sheet to be printed on may be arbitrarily selected, as long as printing is possible.

All or a portion of the function of each unit included in the printer 1 according to this embodiment may also be implemented by recording a program for implementing those functions in a computer-readable recording medium, and reading and executing the program recorded in the recording medium on a computer system. As used herein, the computer system may include an operating system (OS) and hardware, e.g., a peripheral device.

The term "computer-readable recording medium" refers to portable media, such as a flexible disk, a magneto-optical disc, a ROM, and a CD-ROM, or a storage unit included in the computer system, e.g., a hard disk. The term "computer-readable recording medium" may also refer to a medium configured to dynamically hold a program for a short period of time, like a communication cable when transmitting a program via a network, e.g., the Internet, or a communication line, e.g., a telephone line, or to a medium configured to hold a program for a fixed period of time, like a volatile memory in a computer system serving as a server or a client in such a case. The above-mentioned program may be a program for implementing a portion of the above-mentioned functions, or may be capable of implementing the above-mentioned functions in combination with a program already recorded in the computer system.

In this embodiment, mark detection is performed by the printer 1. However, the mark detection according to this embodiment may also be applied to a device other than the printer 1.

What is claimed is:

1. A printer, comprising:

a conveying unit configured to convey a sheet having a detection area on at least a portion of a sheet surface;

a sensor configured to output detection signals having values reflecting a surface condition of the sheet conveyed by the conveying unit;

an acquisition unit configured to acquire, at a predetermined interval relative to a minimum amount of conveyance of the sheet, the detection signals output from the sensor;

a detection unit configured to differentiate the detection signals to derive change amounts of the detection signals acquired at the predetermined interval by the acquisition unit, and integrate the change amounts of the detection signals to derive an area signal representative of the detection area on the sheet; and a printing control unit configured to control a printing position for printing on the sheet with reference to the area signal derived by the detection unit.

2. A printer according to claim 1, wherein the detection unit is configured to:

integrate a change amount each time the acquisition unit acquires the detection signal at the predetermined interval; and determine that the detection area is detected when the area signal is continuously higher than a threshold value for a period equal to or more than a predetermined time period.

3. A printer according to claim 2, wherein the detection unit is configured to clip a value of the area signal to a specific value when the value of the area signal is a negative value.

4. A printer according to claim 3, wherein the specific value selected in advance from a range between zero and a positive value.

5. A printer according to claim 1, wherein the detection unit is configured to clip a value of the area signal to a specific value when the value of the area signal is a negative value.

6. A printer according to claim 5, wherein the specific value is selected in advance from a range between zero and a positive value.

7. A detection method, including:

conveying, by a conveying unit, a sheet having a detection area on at least a portion of a sheet surface;

at a predetermined interval relative to a minimum amount of conveyance of the sheet, acquiring, by an acquisition unit, detection signals output from a sensor, the detection signals having values reflecting a surface condition of the sheet conveyed by the conveying unit;

differentiating, by a detection unit, the detection signals to derive change amounts of the detection signals acquired at the predetermined interval in the acquiring;

integrating, by the detection unit, the change amounts of the detection signals to derive an area signal representative of the detection area on the sheet; and controlling, by a printing control unit, a printing position for printing on the sheet with reference to the area signal derived by the detection unit.

8. A detection method according to claim 7, wherein integrating the change amounts of the detection signals comprises integrating the change amount each time the acquisition unit acquires the detection signal at the predetermined interval, and the method further comprising determining, by the detection unit, that the detection area is detected when the area signal is continuously higher than a threshold value for a period equal to or more than a predetermined time period.

9. A detection method according to claim 8, further comprising clipping, by the detection unit, a value of the area signal to a specific value when the value of the area signal is a negative value.

10. A detection method according to claim 9, wherein the specific value is selected in advance from a range between zero and a positive value.

11. A detection method according to claim 10, further comprising clipping, by the detection unit, a value of the area signal to a specific value when the value of the area signal is a negative value.

12. A detection method according to claim 11, wherein the specific value is selected from a range between zero and a positive value.

* * * * *